US009476387B2

(12) United States Patent
Kim et al.

(10) Patent No.: US 9,476,387 B2
(45) Date of Patent: Oct. 25, 2016

(54) SYSTEM FOR DETERMINING EGR COOLER DEGRADATION

(75) Inventors: Yong-Wha Kim, Ann Arbor, MI (US); Michiel J. Van Nieuwstadt, Ann Arbor, MI (US); Eric Kurtz, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 930 days.

(21) Appl. No.: 13/107,023

(22) Filed: May 13, 2011

(65) Prior Publication Data

US 2012/0290190 A1 Nov. 15, 2012

(51) Int. Cl.
*F02M 25/07* (2006.01)
*F02D 41/00* (2006.01)

(52) U.S. Cl.
CPC ..... *F02M 26/33* (2016.02); *F02M 26/25* (2016.02); *F02M 26/49* (2016.02); *F02D 2041/0067* (2013.01); *F02M 26/27* (2016.02); *F02M 26/47* (2016.02)

(58) Field of Classification Search
CPC ..... F02M 25/0707; F02M 25/0728; F02M 25/0731; F02M 25/0709; F02M 25/0702; F02M 25/0754; Y02T 10/121
USPC ..... 701/101, 102, 107, 110, 108; 123/568.12, 568.18, 568.16; 60/605.2; 73/114.74
See application file for complete search history.

(56) References Cited

U.S. PATENT DOCUMENTS 4,116,175 A * 9/1978 Sand ..... 123/406.42
5,727,533 A 3/1998 Bidner et al.
5,732,688 A * 3/1998 Charlton ..... F02D 21/08 123/568.12
6,085,732 A 7/2000 Wang et al.
6,347,619 B1 * 2/2002 Whiting et al. ..... 123/568.12
6,367,256 B1 * 4/2002 McKee ..... 60/605.2
7,715,975 B2 * 5/2010 Yamaoka et al. ..... 701/103
7,832,259 B2 * 11/2010 Wang et al. ..... 73/114.25
7,931,013 B2 * 4/2011 Castaño Gonzalez et al. ..... 123/568.12
7,987,836 B2 * 8/2011 Kurtz et al. ..... 123/568.12
8,103,428 B2 * 1/2012 Russ et al. ..... 701/108
8,230,843 B2 * 7/2012 Kurtz ..... 123/568.12
2006/0042608 A1 * 3/2006 Buck ..... F02B 29/0437 123/568.12
2008/0178843 A1 * 7/2008 Duffy et al. ..... 123/435
2009/0020263 A1 * 1/2009 Ohsawa et al. ..... 165/104.11
2010/0043525 A1 2/2010 Recouvreur et al.
2010/0307231 A1 * 12/2010 Allard et al. ..... 73/114.74
2011/0131957 A1 * 6/2011 Hepburn et al. ..... 60/278
2012/0096855 A1 * 4/2012 Farmer ..... 60/605.2
2013/0186074 A1 * 7/2013 Kanba et al. ..... 60/286
2013/0213007 A1 * 8/2013 Harden et al. ..... 60/272
2013/0343421 A1 * 12/2013 Yanakiev ..... F02D 41/18 374/1

FOREIGN PATENT DOCUMENTS

WO 2010013123 A1 2/2010
WO 2012004831 A1 12/2012

* cited by examiner

*Primary Examiner* — Stephen K Cronin
*Assistant Examiner* — Gonzalo Laguarda
(74) *Attorney, Agent, or Firm* — Julia Voutyras; Alleman Hall McCoy Russell & Tuttle LLP

(57) ABSTRACT

Systems and methods for diagnosing an EGR system are presented. The method provides for indicating EGR system degradation in response to a temperature at an outlet of an EGR cooler. The method may require less calibration effort than a model based diagnostic.

17 Claims, 4 Drawing Sheets

SYSTEM FOR DETERMINING EGR COOLER DEGRADATION

FIELD

The present description relates to a method and system for improving operation and diagnosis of an exhaust gas recirculation (EGR) system. The approach may be particularly useful for engines that have cooled EGR.

BACKGROUND AND SUMMARY

An EGR may be included with an engine to help reduce engine emissions and increase engine efficiency. In some systems EGR may be cooled via a cooler that is in communication with the engine exhaust passage and the engine intake manifold. The EGR system may further include a bypass valve for directing EGR around the EGR cooler such that EGR is directed from the exhaust passage to the engine intake manifold. Thus, the EGR system can provide cooled or exhaust gas temperature EGR gas to the engine depending on engine operating conditions to improve engine emissions and fuel economy. However, it may be possible for the EGR cooler and/or EGR cooler bypass valve to degrade during some conditions. For example, it may be possible for the EGR bypass valve to remain in an open or closed position when it is desired for the EGR bypass valve to assume the opposite position. Further, since EGR may contain soot, it may be possible for soot to accumulate in the EGR cooler causing the cooling capacity of the EGR cooler to degrade.

Some EGR cooling systems use an EGR model in an attempt to determine whether or not an EGR system having an EGR cooler and an EGR cooler bypass valve is operating as desired. The EGR system model may attempt to assess the operating efficiency of the EGR cooler and EGR valve position based on EGR cooler inlet and outlet temperatures. However, EGR system models can require extensive calibration time and may not agree well with the physical system during some operating conditions. For example, immediately after opening an EGR bypass valve to allow cooled EGR to flow to the engine intake system, the EGR temperature estimate may not agree with the measured EGR temperature since it may be difficult to determine how much heat has been extracted from the exhaust gases in the EGR cooler while untreated exhaust gases were flowing to the engine intake manifold. As such, a difference between the model based EGR temperature and the actual EGR temperature may result in an indication of EGR cooling system degradation.

The inventors herein have recognized the above-mentioned disadvantages and have developed a method for diagnosing an EGR system. One example of the present description includes an EGR system diagnostic method, comprising: operating an engine with an EGR bypass valve in a first state for a time greater than a threshold amount of time; indicating a condition of EGR cooler system degradation in response to a request to transition the EGR bypass valve to a second state and a temperature difference between an actual EGR gas temperature and an expected EGR gas temperature before transitioning the state of the EGR bypass valve and at a time greater than the threshold.

By operating an EGR system having an EGR cooler and an EGR bypass valve for a threshold amount of time before comparing an actual EGR gas temperature to an expected EGR gas temperature, it may be possible to determine whether or not an EGR system is operating as desired with little calibration effort. For example, an actual EGR gas temperature may be compared to an expected EGR gas temperature after a threshold amount of time has elapsed. The threshold amount of time may correspond to an amount of time for EGR gases to equilibrate to a temperature after a change in the EGR bypass valve position. Thus, rather than modeling and calibrating an EGR cooler and EGR bypass valve, an empirically determined table or function of EGR gas temperature values may be used as a basis for determining EGR system degradation.

The present description may provide several advantages. In particular, the approach can reduce the amount of time for calibrating EGR system diagnostics. In addition, a simplified diagnostic may be provided by the approach described herein. Further, in some examples, the approach may diagnose EGR system degradation based on parameters other than EGR temperature so as to provide additional sources of EGR system operational verification.

The above advantages and other advantages, and features of the present description will be readily apparent from the following Detailed Description when taken alone or in connection with the accompanying drawings.

BRIEF DESCRIPTION OF THE DRAWINGS

The advantages described herein will be more fully understood by reading an example of an embodiment, referred to herein as the Detailed Description, when taken alone or with reference to the drawings, wherein.

DETAILED DESCRIPTION

Figure 1:
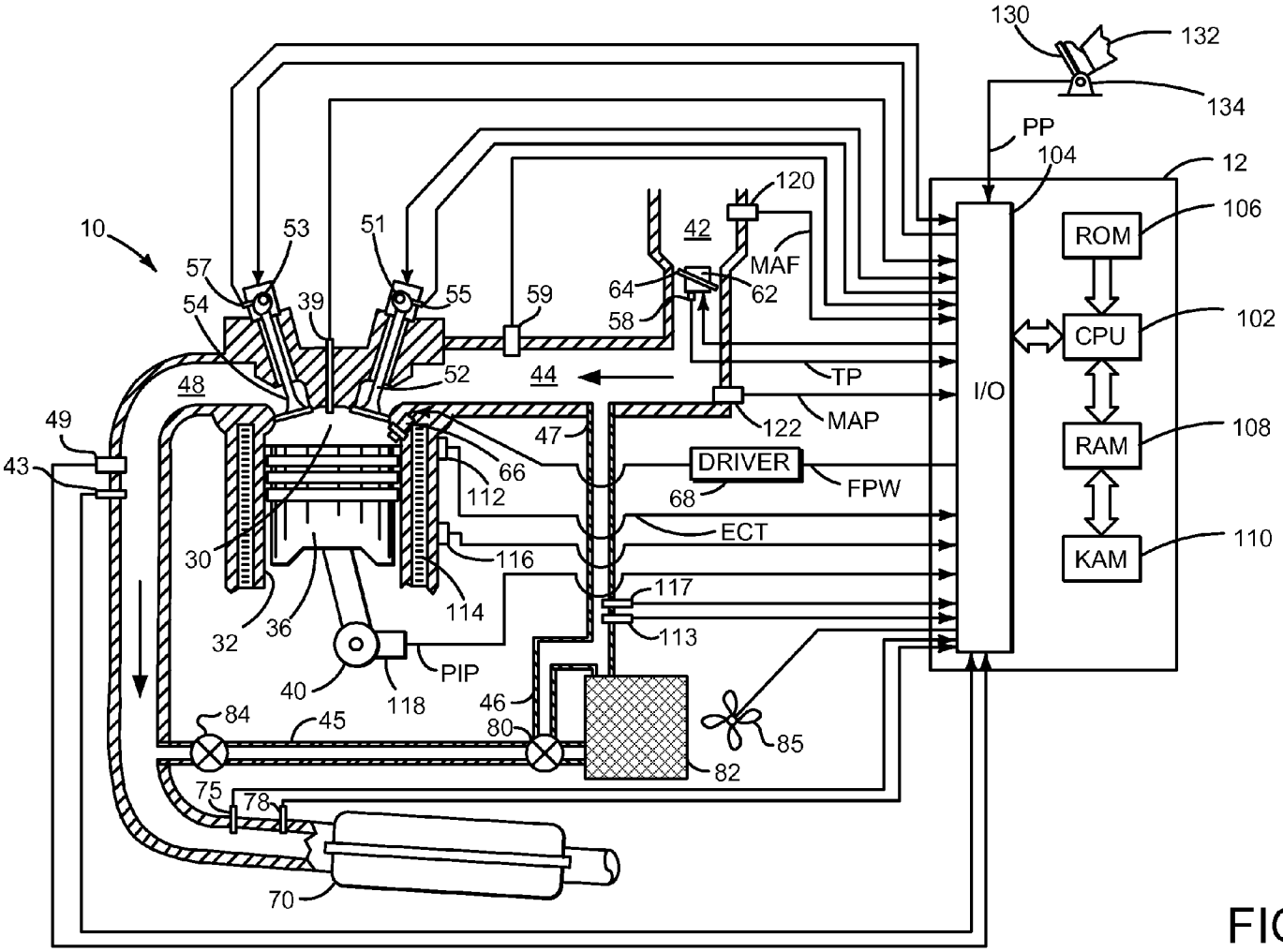
FIG. 1 is a schematic diagram of an engine.
Figure 2:
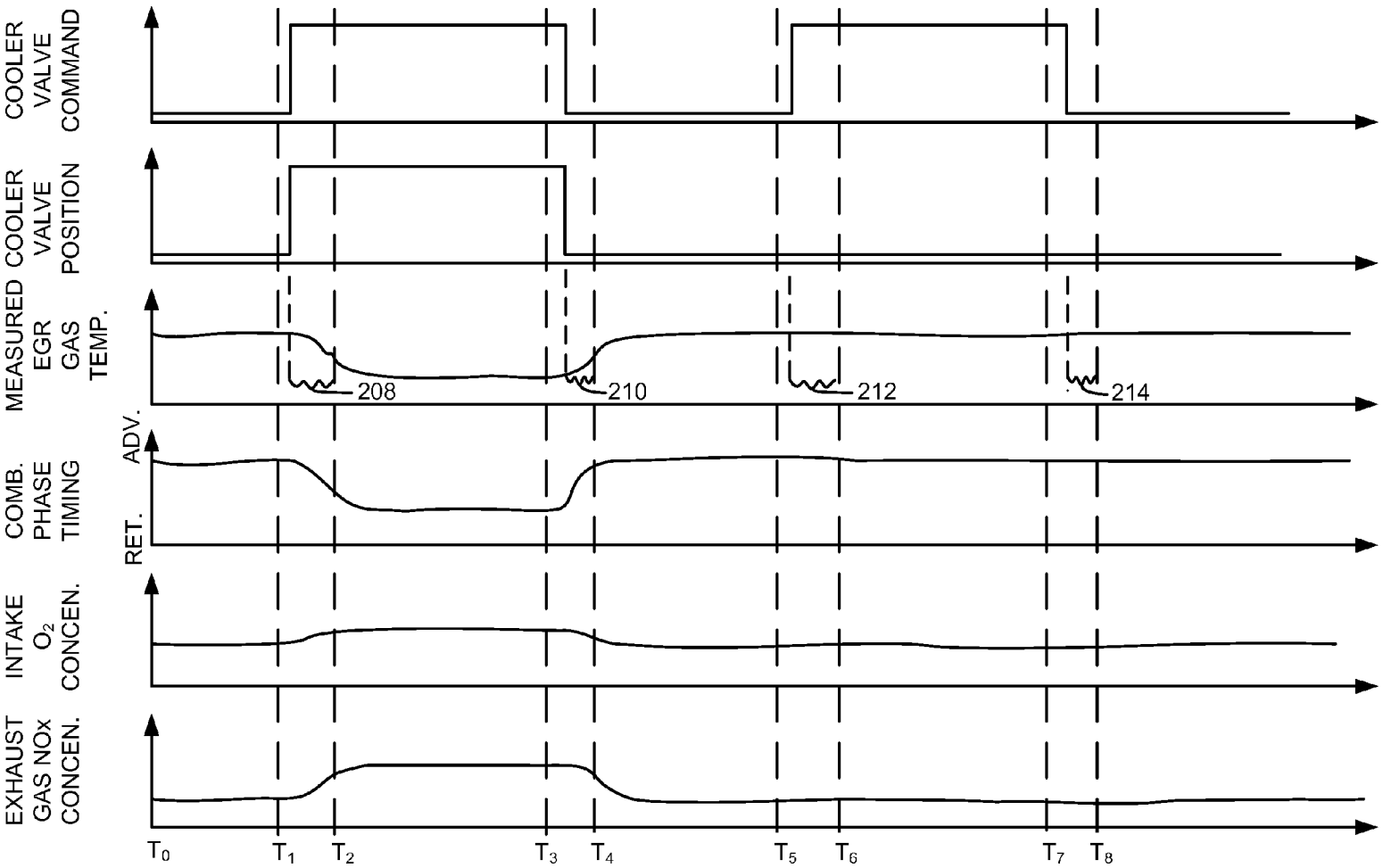
FIGS. 2 and 3 are schematic diagrams of simulated signals of interest when operating an EGR system.
Figure 3:
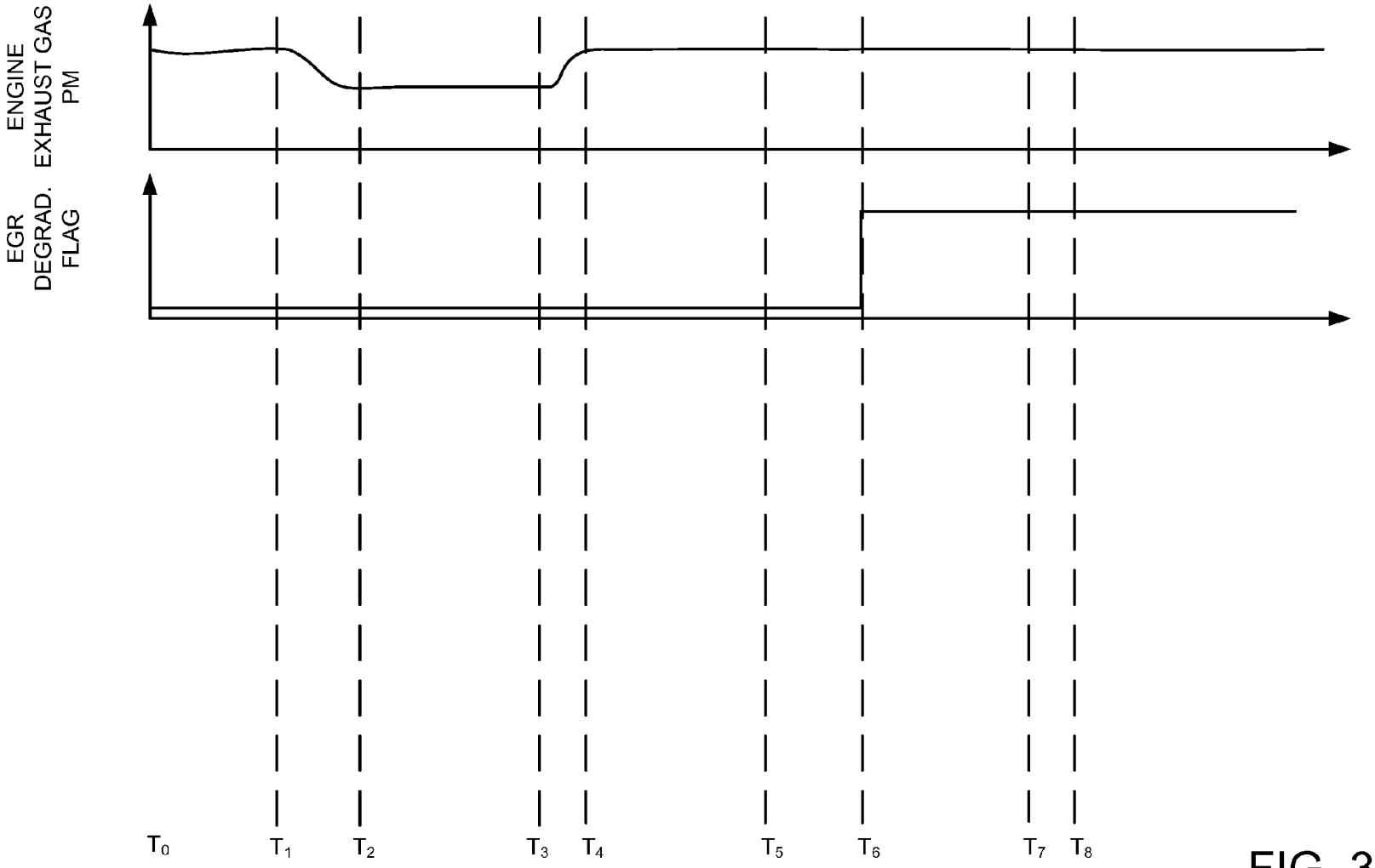

The present description is related to diagnosing degradation of an EGR system. In one example, the EGR system is adapted to a diesel engine as shown in FIG. 1. However, the present description may provide benefits for gasoline and alternative fuel engines as well. Accordingly, this disclosure is not limited to a particular type of engine or a particular EGR system configuration. FIGS. 2-3 show simulated signals of interest when an engine and EGR system are operated according to the method of FIG. 4.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as direct injection. Alternatively, in some engines, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail (not shown). Fuel injector 66 is supplied operating current from driver 68 which responds to controller 12. In addition, intake manifold 44 is shown communicating with optional electronic throttle 62 which adjusts a position of throttle plate 64 to control air flow from air intake 42 to intake manifold 44. In one example, a high pressure dual stage fuel system is used to generate higher fuel pressures.

An air-fuel mixture in combustion chamber 30 may be combusted via compression ignition. For example, fuel may be injected several times during the compression stroke, as the piston approaches top-dead-center compression the air-fuel mixture in the cylinder ignites and the expanding gases drive the piston toward crankshaft 40. Exhaust gases exit combustion chamber 30 into exhaust manifold 48 and flows in the direction of the arrow. Some exhaust gases may be routed to EGR passage 45 when EGR valve 84 is at least partially open. EGR gas entering EGR passage 45 may be routed to bypass passage 46 or to EGR cooler 82 before entering downstream EGR passage 47. Cooler valve 80 is configured to route EGR gases through cooler 82 when not electrically energized by controller 12. Cooler valve 80 routes EGR gases through bypass passage 46 when energized by controller 12. In one example, the engine may be turbocharged or supercharged to provide pressurized air or boost to the engine to increase engine output. EGR may be delivered upstream and/or downstream of the compressor turbine. Optional variable speed electric or mechanically driven fan 85 may supply air to EGR cooler 82 to adjust EGR temperature.

In alternative examples, a distributorless ignition system (not shown) provides an ignition spark to combustion chamber 30 via spark plug (not shown) in response to controller 12. Further, a universal Exhaust Gas Oxygen (UEGO) sensor (not shown) may be coupled to exhaust manifold 48 upstream of after treatment device 70.

After treatment device 70 can include an oxidation catalyst, particulate matter filter, reduction catalyst, or a three way catalyst in gasoline applications. In some examples, additional oxygen sensors may be located downstream of after treatment device 70.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of EGR temperature from temperature sensor 113; a measurement of EGR gas temperature from temperature sensor 117; a measurement of intake $O_2$ concentration from oxygen sensor 59; a measurement of engine manifold pressure (MAP) from pressure sensor 122 coupled to intake manifold 44; a cylinder pressure measurement from pressure sensor 39; a measurement of exhaust O2 concentration from oxygen sensor 49; a measurement of engine feedgas exhaust gas temperature from temperature sensor 43; an engine position sensor from a Hall effect sensor 118 sensing crankshaft 40 position; a measurement of air mass entering the engine from sensor 120; a measure of combustion phasing from knock sensor 116; a measure of engine feedgas particulate matter from particulate sensor 75; a measure of engine feedgas NOx from NOx sensor 78; and a measurement of throttle position from sensor 58. Barometric pressure and exhaust temperature may also be sensed (sensors not shown) for processing by controller 12. In a preferred aspect of the present description, engine position sensor 118 produces a predetermined number of equally spaced pulses every revolution of the crankshaft from which engine speed (RPM) can be determined.

In some embodiments, the engine may be coupled to an electric motor/battery system in a hybrid vehicle. The hybrid vehicle may have a parallel configuration, series configuration, or variation or combinations thereof. Further, in some embodiments, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In some examples, ignition of the air-fuel mixture is via compression ignition while in other examples ignition is by way of a spark plug. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Thus, the system of FIG. 1 provides for an EGR system, comprising: an engine; an EGR cooler in communication with the engine; an EGR cooler bypass circuit; a valve directing EGR gases to the EGR cooler in a first state, the valve directing EGR gases to bypass the EGR cooler in a second state; and a controller, the controller including instructions to indicate a condition of EGR cooler system degradation in based on a request to transition the EGR bypass valve to a second state and a temperature difference between an actual EGR temperature and an expected EGR temperature at a time greater than the threshold amount of time and before transitioning the state of the EGR bypass valve, the controller including further instructions to indicate the condition of EGR cooler system degradation based on NOx produced by the engine. The EGR system includes where the controller includes further instructions for inhibiting indicating the condition of EGR cooler system degradation in response to combustion phasing. The EGR system further comprises a knock sensor for determining combustion phasing. The EGR system further comprises a pressure sensor for determining combustion phasing. In one example, the EGR system includes where the controller includes further instructions for inhibiting indicating the condition of EGR cooler system degradation in response to particulate matter production via an engine, the EGR system coupled to the engine. The EGR system also includes where the controller includes further instructions for inhibiting indicating the condition of EGR cooler system degradation in response to exhaust gas oxygen concentration.

Referring now to FIGS. 2 and 3, schematic diagrams of simulated signals of interest when operating an EGR system are shown. The plots illustrated in FIGS. 2 and 3 are part of one EGR operating sequence and they occur at the same time. Vertical markers $T_0$-$T_8$ are provided to identify certain times of interest during the EGR operating sequence. Thus, the events at time $T_1$ of FIG. 2 occur at the same time as events at time $T_1$ of FIG. 3.

The first plot from the top of FIG. 2 shows a control command signal for an EGR cooler valve (e.g., valve 80 of FIG. 1). The X-axis represents time and time increases from the left to the right. The Y-axis represents the cooler valve command signal. The EGR cooler valve is energized when the signal is at a higher level and de-energized when at a lower level. The cooler valve directs exhaust gas to a cooler when energized. The cooler valve directs exhaust gas to a bypass passage that directs EGR gases around the cooler when the EGR valve is de-energized.

The second plot from the top of FIG. 2 shows a position signal for an EGR cooler valve. The X-axis represents time and time increases from the left to the right. The Y-axis represents the EGR cooler valve position. The EGR cooler valve directs exhaust gas to an EGR cooler when the valve position is at the higher level. The cooler valve directs exhaust gas to a bypass passage when the valve position is at the lower level. The X-axis represents time and time increases from the left to the right.

The third plot from the top of FIG. 2 shows a measured exhaust gas temperature. However, in some examples, exhaust gas temperature may be estimated from engine air flow, injection timing, and engine load. The X-axis represents time and time increases from the left to the right. The Y-axis represents exhaust gas temperature and exhaust gas temperature increases in the direction of the Y-axis arrow.

The fourth plot from the top of FIG. 2 shows a measurement of EGR gas temperature. The EGR gas temperature is the temperature of exhaust gases that are downstream of the bypass line and the cooler (e.g., at 117 of FIG. 1). The X-axis represents time and time increases from the left to the right. The Y-axis represents EGR gas temperature and EGR gas temperature increases in the direction of the Y-axis arrow.

The fifth plot from the top of FIG. 2 shows a measurement of intake $O_2$ concentration. The intake $O_2$ concentration is an oxygen concentration within the engine air intake system (e.g., at 59 of FIG. 1). The X-axis represents time and time increases from the left to the right. The Y-axis represents oxygen concentration and the oxygen concentration increases in the direction of the Y-axis arrow.

The sixth plot from the top of FIG. 2 shows a measurement of intake NOx concentration in the engine feedgas. The NOx concentration is representative of a NOx concentration of engine exhaust gases (e.g., at 78 of FIG. 1) before NOx may be processed by an exhaust gas after treatment device. The X-axis represents time and time increases from the left to the right. The Y-axis represents NOx concentration and the NOx concentration increases in the direction of the Y-axis arrow.

The first plot from the top of FIG. 3 shows exhaust feedgas particulate matter. The X-axis represents time and time increases from the left to the right. The Y-axis represents particulate matter mass and has units of mass (e.g., grams) per kilogram exhaust flow. The particulate matter concentration is representative of particulate matter in engine exhaust gases (e.g., at 75 of FIG. 1) before particulate matter may be processed by particulate filter, for example.

The second plot from the top of FIG. 3 shows an EGR degradation flag output based on engine operating conditions. The X-axis represents time and time increases from the left to the right. The Y-axis represents the state of an EGR degradation flag. The flag is not asserted at the lower level. The flag is asserted at the higher level. The lower level indicates no degradation. The higher level indicates EGR degradation is present.

At time $T_0$, the EGR cooler valve command is at a lower level. The EGR cooler valve command may be adjusted according to engine operating conditions. For example, the position of the EGR cooler valve command is varied depending on engine speed and engine load. Further, the EGR cooler valve command may be varied in response to engine coolant temperature and ambient temperature. When the EGR cooler command is at the lower level, it is desired that the EGR cooler valve bypass engine exhaust gases around the EGR cooler. Thus, the EGR gases are expected to be near engine feedgas exhaust gas temperature when the EGR cooler command is at the lower level. The EGR cooler valve position is also at a lower level at time $T_0$. Consequently, the EGR valve position is consistent with the EGR cooler valve command. The measured or actual EGR gas temperature is shown at a higher level at time $T_0$ and the combustion phasing (e.g., the location of a cylinder's peak pressure relative to crankshaft position) is shown having increased advance timing. The intake air system oxygen concentration and exhaust gas NOx concentration are shown at lower levels. The engine exhaust gas particulate matter is shown at a higher level. The EGR system degradation flag is shown at a low level indicating the absence of EGR degradation.

At time $T_1$, engine operating conditions are such that a transition in the state of the EGR valve from the closed position to the open position is requested via the EGR cooler valve command. In one EGR diagnostic example, EGR gas temperature may be measured before transitioning to a newly requested state. The measured or actual EGR gas temperature can be compared to an EGR gas temperature that has been empirically determined and stored in a table or function in memory of a controller. If the actual EGR temperature is less than or greater than the empirically determined EGR gas temperature by more than a predetermined amount, EGR system degradation based on EGR gas temperature may be determined and recorded to memory. In one example, the EGR gas temperature is sampled if the EGR cooler has been in one state for more than a predetermined amount of time. The predetermined amount of time may be based on engine operating conditions. For example, the predetermined amount of time may be adjusted for EGR flow rate and ambient air temperature. The EGR cooler valve position, measured EGR gas temperature, combustion phasing, intake system oxygen concentration, engine exhaust NOx concentration, engine exhaust particulate matter, and EGR system degradation flag are substantially unchanged from time $T_0$.

Between time $T_1$ and time $T_2$, the EGR cooler valve command changes state from a low level to a higher level. The EGR cooler valve position follows the EGR cooler valve command and transitions to allow EGR to flow through the EGR cooler before entering the engine intake system. The change in EGR cooler valve position allows the EGR to cool as indicated by the lower measured EGR gas temperature. The combustion phasing also changes from a more advanced state to a more retarded state. Combustion phasing may be measured via a cylinder pressure sensor or a knock sensor in communication with cylinder pressure or engine vibrations related to cylinder pressure. The engine air intake oxygen concentration also increases as does the exhaust NOx concentration. The engine exhaust particulate matter decreases as the EGR gas temperature decreases. The EGR system degradation flag is shown at a low level indicating absence of EGR system degradation.

At time $T_2$, the EGR gas temperature is measured and compared to a threshold EGR gas temperature. If the change in EGR gas temperature from time $T_1$ to time $T_2$ is less than a threshold level, an EGR system diagnostic may be set. The time 208 from transitioning the EGR cooler valve from a closed position to an open position may be based on an empirically determined time constant (e.g., where the EGR gas temperature is expected to change by more than 63% between the initial and expected EGR temperature after the EGR cooler valve changes state) of the EGR cooler and EGR cooler valve at the present engine operating conditions. Alternatively, the time 208 may be a predetermined time where it is anticipated that the EGR gas temperature will be within a range of the expected EGR gas temperature.

In order to diagnose the EGR system, an EGR gas temperature difference between time $T_1$ and time $T_2$ may be determined. If the EGR gas temperature changes by less than a predetermined amount, EGR system degradation may be determined and an EGR degradation flag may be set. In one example, the predetermined amount of EGR temperature change may be based on engine operating conditions before and after the EGR cooler valve is commanded to change state. For example, a change in EGR gas temperature resulting from a commanded change a state of an EGR valve may be empirically determined and saved to a table or function in memory. The table or function may be indexed via engine operating conditions such as engine speed and air amount. In one example, the EGR gas temperature may be measured before the EGR cooler valve is commanded to change state and after a predetermined amount of time has passed since the EGR cooler valve has been commanded to change state as shown at 208. Similarly, combustion phasing measured in crankshaft degrees, engine air intake oxygen concentration, exhaust gas oxygen concentration, engine feedgas NOx concentration, and engine feedgas particulate matter samples may be taken before and after a commanded state change of the EGR cooler valve. If the combustion phasing, engine air intake oxygen concentration, exhaust gas oxygen concentration, engine feedgas NOx concentration, or engine feedgas particulate matter do not change by a threshold amount the EGR system degradation flag may be set. In the present example, the measured EGR gas temperature, combustion phasing, engine air intake oxygen concentration, engine feedgas NOx concentration, and the engine feedgas particulate matter all change by predetermined amounts and no EGR system degradation flag is set in response to the EGR cooler valve change in state. It should be noted that each of EGR gas temperature, combustion phasing, engine intake air oxygen concentration, engine feedgas NOx concentration, and engine particulate matter may be sampled and compared to predetermined thresholds at different times that are based on time constants of the individual parameters after the EGR cooler valve is commanded to a different state.

Between time $T_2$ and time $T_3$, the EGR cooler valve command and the EGR cooler valve are held constant. The other parameters including EGR gas temperature stabilize at expected values. The EGR system degradation flag remains not asserted.

At time $T_3$, engine operating conditions are such that a transition in the state of the EGR valve from the open position to the closed position is requested. The EGR gas temperature may be measured before transitioning to a newly requested state. The measured or actual EGR gas temperature can be compared to an EGR gas temperature that has been empirically determined and stored in a table or function in memory of a controller. If the actual EGR temperature is less than or greater than the empirically determined EGR gas temperature by more than a predetermined amount, EGR system degradation based on EGR gas temperature may be determined and recorded to memory. In one example, the EGR gas temperature is sampled if the EGR cooler has been in one state for more than a predetermined amount of time.

Between time $T_3$ and $T_4$, the EGR cooler valve command changes state from a higher level to a lower level and the EGR cooler valve follows the EGR cooler valve command. The transition allows EGR to flow bypass the EGR cooler before entering the engine intake system. The change in EGR cooler valve position allows the EGR temperature to increase as indicated by the higher measured EGR gas temperature. The combustion phasing also changes from a more retarded state to a more advanced state. The engine air intake oxygen concentration also decreases as does the engine feedgas NOx concentration. The engine feedgas exhaust particulate matter increases as the EGR gas temperature increases. The EGR system degradation flag is shown at a low level indicating absence of EGR system degradation.

At time $T_4$, the EGR gas temperature is measured and compared to a threshold EGR gas temperature. If the change in EGR gas temperature from time $T_3$ to time $T_4$ is less than a threshold level, an EGR system diagnostic may be set. The time 210 from transitioning the EGR cooler valve from an open position to a closed position may be based on an empirically determined time constant (e.g., where the EGR gas temperature is expected to change by more than 63% between the initial and expected EGR temperature after the EGR cooler valve changes state) of the EGR cooler and EGR cooler valve at the present engine operating conditions. Alternatively, the time 210 may be a predetermined time where it is anticipated that the EGR gas temperature will be within a range of the expected EGR gas temperature. Note that time 210 is shorter than time 208 as commanding the EGR valve to the closed or bypass position requires only a short time for EGR to go from the exhaust system to the EGR temperature sensor whereas additional time is required for exhaust to flow from the exhaust system through the EGR cooler before reaching the EGR temperature sensor. Thus, different amounts of time may be provided when the EGR cooler valve transitions from a closed state to an open state as compared to when the EGR cooler valve transitions from an open state to a closed state.

In order to diagnose the EGR system, an EGR gas temperature difference between time $T_3$ and time $T_4$ may be determined. If the EGR gas temperature changes by less than a predetermined amount, EGR system degradation may be determined and an EGR degradation flag may be set. Similarly, combustion phasing measured in crankshaft degrees, engine air intake oxygen concentration, exhaust gas oxygen concentration, engine feedgas NOx concentration, and engine feedgas particulate matter samples may be taken before and after a commanded state change of the EGR cooler valve. If the combustion phasing, engine air intake oxygen concentration, exhaust gas oxygen concentration, engine feedgas NOx concentration, or engine feedgas particulate matter do not change by a threshold amount the EGR system degradation flag may be set. In the present example, the measured EGR gas temperature, combustion phasing, engine air intake oxygen concentration, engine feedgas NOx concentration, and the engine feedgas particulate matter all change by predetermined amounts and no EGR system degradation flag is set in response to the EGR cooler valve change in state. It should be noted that each of EGR gas temperature, combustion phasing, engine intake air oxygen concentration, engine feedgas NOx concentration, and engine particulate matter may be sampled and compared to predetermined thresholds at different times that are based on time constants of the individual parameters after the EGR cooler valve is commanded to a different state.

Between time $T_4$ and time $T_5$, the EGR cooler valve command and the EGR cooler valve are held constant. The other parameters including EGR gas temperature stabilize at expected values. The EGR system degradation flag remains not asserted.

At time $T_5$, engine operating conditions are such that a transition in the state of the EGR valve from the closed position to the open position is requested via the EGR cooler valve command. In one EGR diagnostic example, EGR gas temperature may be measured before transitioning to a newly requested state. The measured or actual EGR gas temperature can be compared to an EGR gas temperature that has been empirically determined and stored in a table or function in memory of a controller. If the actual EGR temperature is less than or greater than the empirically determined EGR gas temperature by more than a predetermined amount, EGR system degradation based on EGR gas temperature may be determined and recorded to memory. In one example, the EGR gas temperature is sampled if the EGR cooler has been in one state for more than a predetermined amount of time. The predetermined amount of time may be based on engine operating conditions.

Between time $T_5$ and time $T_6$, the EGR cooler valve command changes state from a low level to a higher level. The EGR cooler valve position does not follow the EGR cooler valve command and it remains in a closed position such that EGR is not allowed flow through the EGR cooler before entering the engine intake system. As such, the EGR gas temperature remains relatively high. Further, the combustion phasing does not substantially change. The engine air intake oxygen concentration also stays substantially the same as does the exhaust NOx concentration. The engine exhaust particulate matter also stays at a same level.

At time $T_6$, the EGR gas temperature is measured and compared to a threshold EGR gas temperature. Since there the change in EGR gas temperature from time $T_5$ to time $T_6$ is less than a threshold level, an EGR system diagnostic is set. The time 212 from transitioning the EGR cooler valve command from a closed position to an open position may be based on an empirically determined time constant. Alternatively, the time 212 may be a predetermined time where it is anticipated that the EGR gas temperature will be within a range of the expected EGR gas temperature.

The EGR gas temperature difference between time $T_5$ and time $T_6$ may be determined at or after time $T_6$. Since the EGR gas temperature changes by less than a predetermined amount, EGR system degradation is determined and an EGR degradation flag is set. Similarly, combustion phasing measured in crankshaft degrees, engine air intake oxygen concentration, exhaust gas oxygen concentration, engine feedgas NOx concentration, and engine feedgas particulate matter samples may be taken before and after a commanded state change of the EGR cooler valve. Since the combustion phasing, engine air intake oxygen concentration, exhaust gas oxygen concentration, engine feedgas NOx concentration, or engine feedgas particulate matter do not change by a threshold amount, the EGR system degradation flag is set.

Between time $T_6$ and time $T_7$, the EGR cooler valve command is held constant and the EGR cooler valve remains stationary. The other parameters including EGR gas temperature remain apart from expected values. The EGR system degradation flag remains asserted.

At time $T_7$, engine operating conditions are such that a transition in the state of the EGR valve from the open position to the closed position is requested. The EGR gas temperature may be measured before transitioning to a newly requested state. The measured or actual EGR gas temperature can be compared to an EGR gas temperature that has been empirically determined and stored in a table or function in memory of a controller. Since the actual EGR temperature is greater than the empirically determined EGR gas temperature by more than a predetermined amount, EGR system degradation based on EGR gas temperature is determined and recorded to memory.

Between time $T_7$ and $T_8$, the EGR cooler valve command changes state from a higher level to a lower level and the EGR cooler valve remains in a closed or bypass state. Thus, EGR continues to flow through the bypass before entering the engine intake system. Since the EGR valve does not change position, the EGR temperature remains substantially the same. The combustion phasing remains at a more advanced state. The engine air intake oxygen concentration remains lower as does the engine feedgas NOx concentration. The engine feedgas exhaust particulate matter also remains substantially constant and the EGR system degradation flag remains asserted to indicate EGR system degradation.

At time $T_8$, the EGR gas temperature is measured and compared to a threshold EGR gas temperature. Since the change in EGR gas temperature from time $T_7$ to time $T_8$ is less than a threshold level, an EGR system diagnostic remains set. The time 214 from transitioning the EGR cooler valve command from an open position to a closed position may be based on an empirically determined time constant of the EGR cooler and EGR cooler valve at the present engine operating conditions. Alternatively, the time 214 may be a predetermined time where it is anticipated that the EGR gas temperature will be within a range of the expected EGR gas temperature. Again note that time 214 is shorter than time 212 as commanding the EGR valve to the closed or bypass position requires only a short time for EGR to go from the exhaust system to the EGR temperature sensor whereas additional time is required for exhaust to flow from the exhaust system through the EGR cooler before reaching the EGR temperature sensor.

In order to diagnose the EGR system, an EGR gas temperature difference between time $T_7$ and time $T_8$ may be determined. Similarly, combustion phasing measured in crankshaft degrees, engine air intake oxygen concentration, exhaust gas oxygen concentration, engine feedgas NOx concentration, and engine feedgas particulate matter samples may be taken before and after a commanded state change of the EGR cooler valve. Since the combustion phasing, engine air intake oxygen concentration, exhaust gas oxygen concentration, engine feedgas NOx concentration, or engine feedgas particulate matter do not change by a threshold amount the EGR system degradation flag is set. The plot variables remain substantially constants after time $T_8$.

Figure 4:
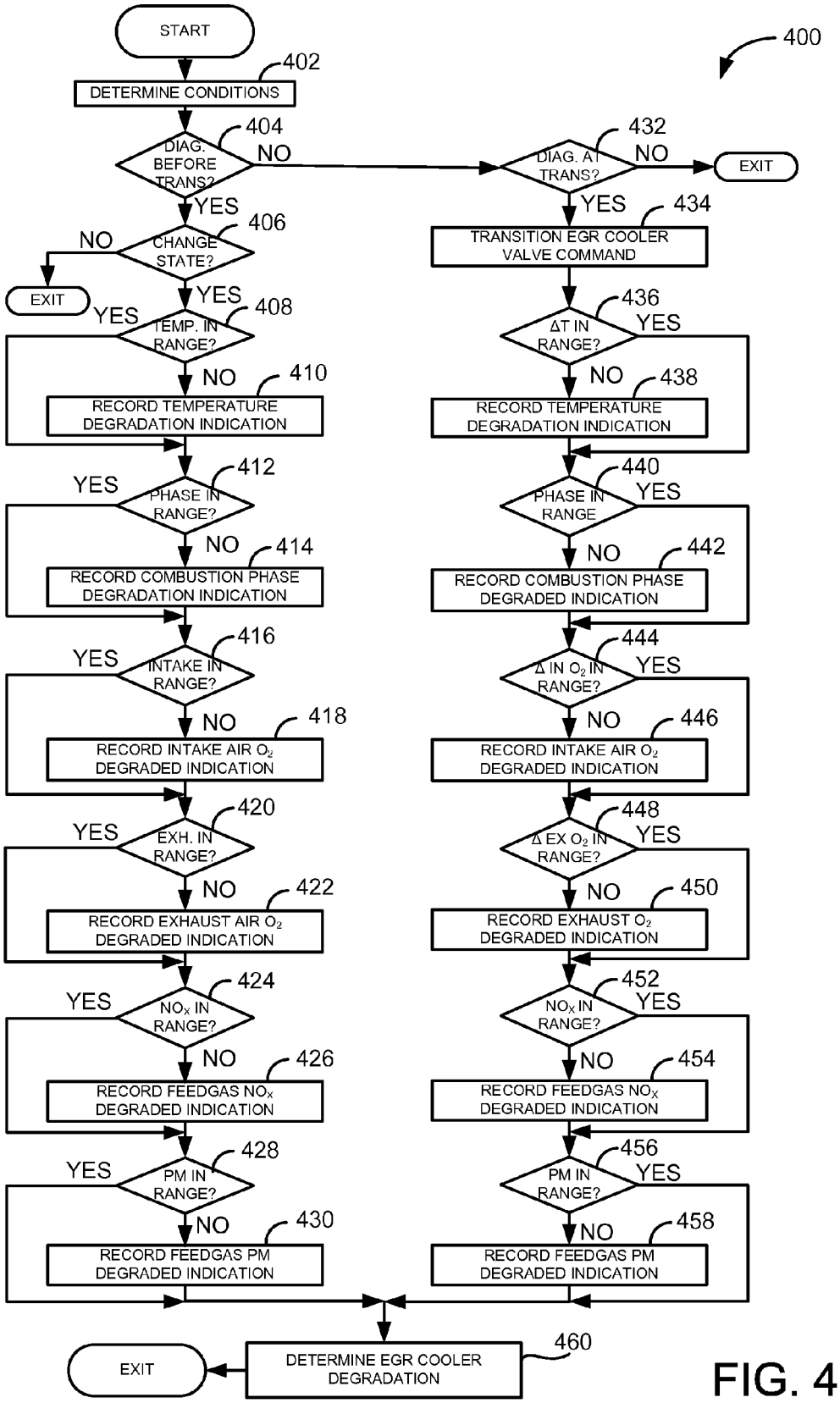
FIG. 4 is a flowchart of a method for diagnosing operation of an EGR system.

Referring now to FIG. 4, a flowchart of a method for diagnosing operation of an EGR system is shown. The method of FIG. 4 may be implemented via controller instructions for a controller 12 as shown in FIG. 1. Further, the signals and plots of FIGS. 2 and 3 may be provided via the method of FIG. 4. The method of FIG. 4 may diagnose EGR cooler system temperature control degradation.

At 402, engine operating conditions are determined. Engine operating conditions may include but are not limited to engine speed, engine air amount, EGR gas temperature, ambient temperature and pressure, engine feedgas exhaust temperature, combustion phasing, engine intake air oxygen concentration, exhaust gas oxygen concentration, engine feedgas NOx concentration, and engine feedgas particulate matter. Method 400 proceeds to 404 after engine operating conditions are determined.

At 404, method 400 judges whether or not conditions are met to diagnose EGR system operation before an EGR cooler valve transition is commanded. In one example, conditions may include a calibration instruction while in other examples method 400 may judge whether or not to diagnose EGR system operation based on engine operating conditions such as engine speed and air amount. Method 400 proceeds to 406 if it is judged that conditions are met to diagnose the EGR system before a EGR valve transition. Otherwise, method 400 proceeds to 432.

At 406, method 400 judges whether or not a request for a change in state of the EGR cooler valve is requested and if the EGR cooler valve has been in its present position for a predetermined amount of time. The predetermined amount of time may be empirically determined and stored in memory that is indexed by engine operating conditions such as engine speed and engine air amount. If the EGR cooler valve has not been in its present state long enough for reliably diagnosing EGR system operation, method 400 proceeds to exit. Otherwise, method 400 proceeds to 408.

At 408, method 400 judges whether or not EGR gas temperature is within a predetermined range of an expected EGR gas temperature for the present engine operating conditions. In one example, the expected EGR gas temperature is empirically determined and stored in memory and indexed by engine speed and engine air amount. If the EGR gas temperature is in the predetermined range, method 400 proceeds to 412. Otherwise, method 400 proceeds to 410.

At 410, method 400 records the present EGR gas temperature and an indication of degraded EGR gas temperature. Since EGR gas temperature may not be definitive of EGR system degradation, method 400 stores the EGR gas temperature degradation indication and continues to evaluate other EGR system related parameters until a final EGR system evaluation is performed at 460. In alternative examples, a determination of EGR system degradation may be based solely on EGR gas temperature before commanding an EGR cooler valve state transition. Method 400 proceeds to 412 after recording degraded conditions.

At 412, method 400 judges whether or not cylinder combustion phasing (e.g., timing of a cylinder's peak pressure relative to crankshaft position) is within a predetermined range of an expected combustion phasing for the present engine operating conditions. In one example, the expected combustion phasing is empirically determined and stored in memory and indexed by engine speed and engine air amount. If the cylinder combustion phasing is in the predetermined range, method 400 proceeds to 416. Otherwise, method 400 proceeds to 414.

At 414, method 400 records the present cylinder combustion phasing and an indication of degraded cylinder combustion phasing. Since cylinder combustion phasing may not be definitive of EGR system degradation, method 400 stores the cylinder combustion phase degradation indication and continues to evaluate other EGR system related parameters until a final EGR system evaluation is performed at 460. In alternative examples, a determination of EGR system degradation may be based solely on cylinder combustion phasing before commanding an EGR cooler valve state transition. Method 400 proceeds to 416 after recording degraded conditions.

At 416, method 400 judges whether or not engine air intake oxygen concentration is within a predetermined range of an expected engine air intake oxygen concentration for the present engine operating conditions. In one example, the expected engine air intake oxygen concentration is empirically determined and stored in memory and indexed by engine speed and engine air amount. If the engine air intake oxygen concentration is in the predetermined range, method 400 proceeds to 420. Otherwise, method 400 proceeds to 418.

At 418, method 400 records the present engine air intake oxygen concentration and an indication of degraded engine air intake oxygen concentration. Since engine air intake oxygen concentration may not be definitive of EGR system degradation, method 400 stores the engine air intake oxygen concentration degradation indication and continues to evaluate other EGR system related parameters until a final EGR system evaluation is performed at 460. In alternative examples, a determination of EGR system degradation may be based solely on engine air intake oxygen concentration before commanding an EGR cooler valve state transition. Method 400 proceeds to 420 after recording degraded conditions.

At 420, method 400 judges whether or not engine exhaust gas oxygen concentration is within a predetermined range of an expected engine exhaust gas oxygen concentration for the present engine operating conditions. In one example, the expected engine exhaust gas oxygen concentration is empirically determined and stored in memory and indexed by engine speed and engine air amount. If the engine exhaust gas oxygen concentration is in the predetermined range, method 400 proceeds to 424. Otherwise, method 400 proceeds to 422.

At 422, method 400 records the present engine exhaust gas oxygen concentration and an indication of degraded engine exhaust gas oxygen concentration. Since engine exhaust gas oxygen concentration may not be definitive of EGR system degradation, method 400 stores the engine exhaust gas oxygen concentration degradation indication and continues to evaluate other EGR system related parameters until a final EGR system evaluation is performed at 460. In alternative examples, a determination of EGR system degradation may be based solely on engine exhaust gas oxygen concentration before commanding an EGR cooler valve state transition. Method 400 proceeds to 424 after recording degraded conditions.

At 424, method 400 judges whether or not engine feedgas NOx concentration is within a predetermined range of an expected engine feedgas NOx concentration for the present engine operating conditions. In one example, the expected engine feedgas NOx concentration is empirically determined and stored in memory and indexed by engine speed and engine air amount. If the engine feedgas NOx concentration is in the predetermined range, method 400 proceeds to 428. Otherwise, method 400 proceeds to 426.

At 426, method 400 records the present engine feedgas NOx concentration and an indication of degraded engine feedgas NOx concentration. Since engine feedgas NOx concentration may not be definitive of EGR system degradation, method 400 stores the engine feedgas NOx concentration degradation indication and continues to evaluate other EGR system related parameters until a final EGR system evaluation is performed at 460. In alternative examples, a determination of EGR system degradation may be based solely on engine feedgas NOx concentration before commanding an EGR cooler valve state transition. Method 400 proceeds to 428 after recording degraded conditions.

At 428, method 400 judges whether or not engine feedgas particulate matter is within a predetermined range of an expected engine feedgas particulate matter for the present engine operating conditions. In one example, the expected engine feedgas particulate matter is empirically determined and stored in memory and indexed by engine speed and engine air amount. If the engine feedgas particulate matter is in the predetermined range, method 400 proceeds to 460. Otherwise, method 400 proceeds to 430.

At 430, method 400 records the present engine feedgas particulate matter and an indication of degraded engine feedgas particulate matter. Since engine feedgas particulate matter may not be definitive of EGR system degradation, method 400 stores the engine feedgas particulate matter degradation indication and continues to evaluate other EGR system related parameters until a final EGR system evaluation is performed at 460. In alternative examples, a determination of EGR system degradation may be based solely on engine feedgas particulate matter before commanding an EGR cooler valve state transition. Method 400 proceeds to 460 after recording degraded conditions.

At 432, method 400 judges whether or not conditions are met to diagnose EGR system degradation at the transition of the EGR cooler valve. In one example, the conditions may include engine operating conditions within a selected range. In other examples, a calibration variable may be programmed such that the EGR system is diagnosed at every time the EGR cooler valve changes state. If method 400 judges conditions are met to diagnose the EGR system during the EGR cooler valve transition, method 400 proceeds to 434. Otherwise, method 400 exits.

At 434, method 400 transitions the state of the EGR cooler valve command according to the EGR request to change EGR cooler valve state. In one example, the EGR cooler valve command may transition from a higher level to a lower level to close an EGR passage to the EGR cooler.

At 436, method 400 judges whether or not a change in EGR gas temperature is within a predetermined range of an expected change in EGR gas temperature for the present engine operating conditions. In one example, the expected change in EGR gas temperature is empirically determined and stored in memory and indexed by engine speed and engine air amount. If the change in EGR gas temperature is in the predetermined range, method 400 proceeds to 440. Otherwise, method 400 proceeds to 438.

At 438, method 400 records the present EGR gas temperature and an indication of degraded EGR gas temperature. Since change in EGR gas temperature may not be definitive of EGR system degradation, method 400 stores the change in EGR gas temperature degradation indication and continues to evaluate other EGR system related parameters until a final EGR system evaluation is performed at 460. In alternative examples, a determination of EGR system degradation may be based solely on change in EGR gas temperature after commanding an EGR cooler valve state transition. Method 400 proceeds to 440 after recording degraded conditions.

At 440, method 400 judges whether or not change in cylinder combustion phasing (e.g., timing of a cylinder's peak pressure relative to crankshaft position) is within a predetermined range of an expected change in combustion phasing for the present engine operating conditions. In one example, the expected change in combustion phasing is empirically determined and stored in memory and indexed by engine speed and engine air amount. If the change in cylinder combustion phasing is in the predetermined range, method 400 proceeds to 444. Otherwise, method 400 proceeds to 442.

At 442, method 400 records the present change in cylinder combustion phasing and an indication of degraded change in cylinder combustion phasing. Since change in cylinder combustion phasing may not be definitive of EGR system degradation, method 400 stores the change in cylinder combustion phase degradation indication and continues to evaluate other EGR system related parameters until a final EGR system evaluation is performed at 460. In alternative examples, a determination of EGR system degradation may be based solely on change in cylinder combustion phasing before commanding an EGR cooler valve state transition. Method 400 proceeds to 444 after recording degraded conditions.

At 444, method 400 judges whether or not change in engine air intake oxygen concentration is within a predetermined range of an expected change in engine air intake oxygen concentration for the present engine operating conditions. In one example, the expected change in engine air intake oxygen concentration is empirically determined and stored in memory and indexed by engine speed and engine air amount. If the change in engine air intake oxygen concentration is in the predetermined range, method 400 proceeds to 448. Otherwise, method 400 proceeds to 446.

At 446, method 400 records the present change in engine air intake oxygen concentration and an indication of degraded change in engine air intake oxygen concentration. Since change in engine air intake oxygen concentration may not be definitive of EGR system degradation, method 400 stores the change in engine air intake oxygen concentration degradation indication and continues to evaluate other EGR system related parameters until a final EGR system evaluation is performed at 460. In alternative examples, a determination of EGR system degradation may be based solely on change in engine air intake oxygen concentration before commanding an EGR cooler valve state transition. Method 400 proceeds to 448 after recording degraded conditions.

At 448, method 400 judges whether or not change in engine exhaust gas oxygen concentration is within a predetermined range of an expected change in engine exhaust gas oxygen concentration for the present engine operating conditions. In one example, the expected change in engine exhaust gas oxygen concentration is empirically determined and stored in memory and indexed by engine speed and engine air amount. If the change in engine exhaust gas oxygen concentration is in the predetermined range, method 400 proceeds to 452. Otherwise, method 400 proceeds to 450.

At 450, method 400 records the present change in engine exhaust gas oxygen concentration and an indication of degraded engine exhaust gas oxygen concentration. Since change in engine exhaust gas oxygen concentration may not be definitive of EGR system degradation, method 400 stores the change in engine exhaust gas oxygen concentration degradation indication and continues to evaluate other EGR system related parameters until a final EGR system evaluation is performed at 460. In alternative examples, a determination of EGR system degradation may be based solely on change in engine exhaust gas oxygen concentration before commanding an EGR cooler valve state transition. Method 400 proceeds to 452 after recording degraded conditions.

At 452, method 400 judges whether or not change in engine feedgas NOx concentration is within a predetermined range of an expected change in engine feedgas NOx concentration for the present engine operating conditions. In one example, the expected change in engine feedgas NOx concentration is empirically determined and stored in memory and indexed by engine speed and engine air amount. If the change in engine feedgas NOx concentration is in the predetermined range, method 400 proceeds to 456. Otherwise, method 400 proceeds to 454.

At 454, method 400 records the present change in engine feedgas NOx concentration and an indication of degraded change in engine feedgas NOx concentration. Since change in engine feedgas NOx concentration may not be definitive of EGR system degradation, method 400 stores the change in engine feedgas NOx concentration degradation indication and continues to evaluate other EGR system related parameters until a final EGR system evaluation is performed at 460. In alternative examples, a determination of EGR system degradation may be based solely on change in engine feedgas NOx concentration before commanding an EGR cooler valve state transition. Method 400 proceeds to 456 after recording degraded conditions.

At 456, method 400 judges whether or not change in engine feedgas particulate matter is within a predetermined range of an expected change in engine feedgas particulate matter for the present engine operating conditions. In one example, the expected change in engine feedgas particulate matter is empirically determined and stored in memory and indexed by engine speed and engine air amount. If the change in engine feedgas particulate matter is in the predetermined range, method 400 proceeds to 460. Otherwise, method 400 proceeds to 458.

At 458, method 400 records the present change in engine feedgas particulate matter and an indication of degraded change in engine feedgas particulate matter. Since change in engine feedgas particulate matter may not be definitive of EGR system degradation, method 400 stores the change in engine feedgas particulate matter degradation indication and continues to evaluate other EGR system related parameters until a final EGR system evaluation is performed at 460. In alternative examples, a determination of EGR system degradation may be based solely on change in engine feedgas particulate matter before commanding an EGR cooler valve state transition. Method 400 proceeds to 460 after recording degraded conditions.

At 460, method 400 determines whether or not the EGR system is degraded based on the record of degrade conditions. In one example, the EGR system may be determined to be degraded if a single degraded condition is stored at 410, 414, 418, 422, 426, 430, 438, 442, 446, 450, 454, or 458. Alternatively, method may require a specific number of degrade conditions be present before determining that the EGR system is degraded. In still other examples, method 400 may assign individual weightings to temperature, particulate matter, oxygen concentration, combustion phasing, and NOx concentration based EGR degradation determination. If a sum of the weighted conditions exceeds a desired threshold, EGR system degradation may be determined. In still another example, selected combinations of degraded conditions may have to be determined to indicate a condition of EGR system degradation. For example, both EGR gas temperature degradation and combustion phase degradation may have to be indicated before EGR system degradation may be asserted. In this way, EGR system degradation may be indicated via multiple sources of information so that EGR system degradation may not be asserted when performance of a single sensor degrades. In one example, EGR system cooler temperature control degradation may be determined from one or more of conditions including combustion phase degradation, engine intake oxygen concentration, exhaust oxygen concentration, exhaust gas NOx concentration, EGR temperature, and engine feedgas particulate matter not changing by a predetermined amount in response to a commanded EGR cooler valve state change. In other examples, a degraded EGR cooler valve may be determined during cooler valve switching from one or more conditions including a lack of combustion phase change, lack of change in engine feedgas particulate matter, lack of change in exhaust gas NOx concentration, lack of change in exhaust gas oxygen concentration, and lack of change in engine air intake oxygen concentration. If method 400 determined that the EGR system is degraded, the EGR degradation flag is asserted. Further, in one example, if it is determined that there may be EGR cooler temperature control degradation, speed of an electrically driven fan directed at the EGR cooler may be increased if EGR temperature is determined to be higher than desired. Alternatively, speed of the electrically driven fan may be decreased if EGR temperature is determined to be lower than desired. Method 400 exits after determining whether or not the EGR system is degraded.

Thus, the method of FIG. 4 provides for an EGR system diagnostic method, comprising: operating an engine with an EGR bypass valve in a first state for a time greater than a threshold amount of time; indicating a condition of EGR cooler system degradation in response to a request to transition the EGR bypass valve to a second state and a temperature difference between an actual EGR gas temperature and an expected EGR gas temperature before transitioning the state of the EGR bypass valve. The method also includes where the EGR bypass valve is open in the first state and closed in the second state, and where the EGR cooler system degradation is temperature control degradation. In one example, the EGR bypass valve is closed in the first state and open in the second state. In some examples, the method further comprises comparing an expected combustion phasing to a measured combustion phasing during the first state and suppressing indicating the condition of EGR cooler system degradation when a difference between the expected combustion phasing and the measured combustion phasing is less that a threshold. The method further comprises comparing an expected rate of particulate matter production to a measured rate of particulate matter production during the first state and suppressing indicating the condition of EGR cooler system degradation when a difference between the expected rate of particulate matter production and the measured rate of particulate matter production is less that a threshold. The method also further comprises comparing an expected rate of NOx production to a measured rate of NOx production during the first state and suppressing indicating the condition of EGR cooler system degradation when a difference between the expected rate of NOx production and the measured rate of NOx production is less that a threshold.

The method of FIG. 4 also provides for an EGR system diagnostic method, comprising: operating an engine with an EGR bypass valve in a first state; commanding transitioning the EGR bypass valve to a second state; and indicating a condition of EGR cooler system temperature control degradation in response to a difference in combustion phasing and a EGR temperature determined after commanding transitioning the EGR bypass valve to the second state. The method also includes where the difference in combustion phasing is greater or less than an expected combustion phasing by a threshold amount. In another example, the method includes where the EGR temperature determined after commanding transitioning the EGR bypass valve to the second state varies from an EGR temperature determined when the EGR bypass valve is in the first state by less than a predetermined amount. The method also includes where indicating the condition of EGR cooler system degradation is further based on particulate matter production of the engine. The method includes where particulate matter production of the engine varies by less than a predetermined amount in response to commanding transitioning the EGR bypass valve to the second state. The method further includes where indicating the condition of EGR cooler system degradation is further based on engine NOx production. The method includes where indicating the condition of EGR cooler system degradation is further based on engine intake air oxygen concentration. The method also includes where engine intake air oxygen concentration varies less than a predetermined amount in response to commanding transitioning the EGR bypass valve to the second state.

As will be appreciated by one of ordinary skill in the art, the method described in FIG. 4 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. An EGR system diagnostic method, comprising:

operating an engine with an EGR bypass valve in a first state for a time greater than a threshold amount of time;

requesting a transition in the state of the EGR bypass valve to a second state;

determining an EGR gas temperature difference, the EGR gas temperature difference being a difference between a measured EGR gas temperature before and after the transition;

comparing the EGR gas temperature difference to a temperature difference threshold;

indicating a determined degradation condition of EGR cooler system degradation in response to each of: the request to transition the EGR bypass valve state, a determination that the engine has operated with the EGR bypass valve in the first state for greater time than the threshold amount of time prior to the transition, the EGR gas temperature difference being less than the temperature difference threshold, and an engine exhaust gas oxygen concentration difference being less than an oxygen difference threshold, where the engine exhaust gas oxygen concentration difference is a difference between a measured engine exhaust gas oxygen concentration before and after the transition; and adjusting an actuator responsive to the indication.

2. The method of claim 1, where the EGR bypass valve is open in the first state and closed in the second state, and where the EGR cooler system degradation is temperature control degradation.

3. The method of claim 1, where the EGR bypass valve is closed in the first state and open in the second state, and where the temperature difference threshold is based on engine operating conditions including an engine speed.

4. The method of claim 1, further comprising comparing a combustion phasing difference to a phasing difference threshold and suppressing indicating the determined degradation condition of EGR cooler system degradation when the combustion phasing difference is greater than the phasing difference threshold, where the combustion phasing difference is a difference between a measured combustion phasing before and after the transition.

5. The method of claim 1, further comprising comparing a rate of particulate matter production difference to a particulate matter difference threshold and suppressing indicating the determined degradation condition of EGR cooler system degradation when the rate of particulate matter production difference is greater than the particulate matter difference threshold, where the rate of particulate matter production difference is a difference between a measured rate of particulate matter production before and after the transition.

6. The method of claim 1, further comprising comparing a rate of NOx production difference to a NOx production difference threshold and suppressing indicating the determined degradation condition of EGR cooler system degradation when the rate of NOx production difference is greater than the NOx production difference threshold, where the rate of NOx production difference is a difference between a measured rate of NOx production before and after the transition.

7. The method of claim 1, wherein the indication includes a flag recorded to memory of a controller, and wherein the threshold amount of time is determined based on an EGR flow rate and ambient air temperature, the method further comprising, in response to the EGR bypass valve having not been in the first state for greater than the threshold amount of time, exiting the determination of degradation.

8. The method of claim 7, further comprising adjusting an actuator in response to the determined degradation.

9. An EGR system diagnostic method, comprising:

operating an engine with an EGR cooler valve in a first state allowing exhaust gas to bypass an EGR cooler;

commanding transitioning the EGR cooler valve to a second state;

responsive to the engine being operated in the first state for greater than a threshold time prior to the transition, determining a change in combustion phasing, the change in combustion phasing being a difference between a measured combustion phasing before and after the transition, and determining a change in EGR temperature, the change in EGR temperature being a difference between a measured EGR temperature before and after the transition; and adjusting an actuator based on EGR cooler system temperature control degradation;

where degradation is determined based on the change in combustion phasing being less than a phasing difference threshold and the change in EGR temperature being less than a temperature difference threshold; and where combustion phasing is determined by a location of a cylinder's peak pressure relative to crankshaft position.

10. The method of claim 9, wherein the EGR cooler system temperature control degradation is indicated by setting a flag, the degradation recorded to memory of a controller.

11. The method of claim 9, where EGR cooler system temperature control degradation is further determined in response to a number of degrade conditions exceeding a degradation threshold, said degrade conditions including the change in EGR temperature being less than the temperature difference threshold, the change in combustion phasing being less than the phasing difference threshold, a change in intake oxygen concentration being less than an oxygen difference threshold, a change in exhaust NOx concentration being less than a NOx difference threshold, and a change in particulate matter production being less than a particulate matter difference threshold;

wherein the temperature difference threshold, phasing difference threshold, oxygen difference threshold, NOx difference threshold, and particulate matter difference threshold are based on an engine speed and an air amount, and wherein the threshold time is determined based on an EGR flow rate and ambient air temperature.

12. The method of claim 9, further comprising indicating the EGR cooler system temperature control degradation in response to commanding transitioning the EGR cooler valve to the second state and a change in engine intake air oxygen concentration being less than an oxygen difference threshold, the change in engine intake air oxygen concentration being a difference between a measured engine intake air oxygen concentration before and after transitioning the EGR cooler valve to the second state.

13. The method of claim 12, where the temperature difference threshold is based on engine operating conditions including an engine speed and an air amount, and where the EGR cooler valve allows exhaust gas to pass through the EGR cooler in the second state.

14. The method of claim 12, where the EGR cooler system temperature control degradation is further based on a change in particulate matter production being less than a particulate matter difference threshold, the change in particulate matter production being a difference between a measured particulate matter production before and after transitioning the EGR cooler valve to the second state.

15. The method of claim 12, where the EGR cooler system temperature control degradation is further based on a change in engine NOx production being less than a NOx difference threshold, the change in engine NOx production being a difference between a measured engine NOx production before and after transitioning the EGR cooler valve to the second state.

16. The method of claim 12, where the EGR cooler valve is open in the first state and closed in the second state.

17. The method of claim 12, where the EGR cooler valve is closed in the first state and open in the second state.

* * * * *